United States Patent [19]

Bosch

[11] 3,987,707

[45] Oct. 26, 1976

[54] MULTIPLE-UNIT PUMP

[75] Inventor: Paul Bosch, Ludwigsburg, Germany

[73] Assignee: Robert Bosch G.m.b.H., Stuttgart, Germany

[22] Filed: May 9, 1975

[21] Appl. No.: 576,195

[30] Foreign Application Priority Data

May 20, 1974 Germany ..... 2424390

[52] U.S. Cl. ..... 91/492

[51] Int. Cl.[2] ..... F01B 13/06

[58] Field of Search ..... 91/472, 492, 497, 498, 91/499

[56] References Cited

UNITED STATES PATENTS

| | | | |
|---|---|---|---|
| 2,262,593 | 11/1941 | Thomas et al. | 91/492 |
| 2,871,797 | 2/1959 | Bourassa | 91/472 |
| 3,092,034 | 6/1963 | Bartholomaus | 91/499 |
| 3,094,077 | 6/1963 | Cadiou | 91/472 |
| 3,225,701 | 12/1965 | Griffith | 91/491 |
| 3,357,362 | 12/1967 | Orr | 91/492 |
| 3,803,986 | 4/1974 | Eickmann | 91/492 |
| 3,835,752 | 9/1974 | D'Amata | 91/497 |

*Primary Examiner*—William L. Freeh
*Attorney, Agent, or Firm*—Michael J. Striker

[57] ABSTRACT

The multiple-unit pump of this invention has two coaxial pumps each including a rotatable body. One of the bodies is mounted for rotation on a stationary shaft; a second shaft extends through the stationary shaft and carries intermediate the two rotatable bodies a coupling member which rotates with the second shaft and which is provided with recesses into which projections on the two bodies extend, so that the bodies are caused to rotate when the second shaft is rotated.

10 Claims, 4 Drawing Figures

MULTIPLE-UNIT PUMP

BACKGROUND OF THE INVENTION

This invention relates to a multiple-unit pump.

Multiple-unit pumps having a plurality of pump units that are coupled for joint operation, are already known. However, the manner in which the units of these prior-art constructions are coupled, is relatively complicated and renders these prior-art constructions more expensive to construct and maintain than is desirable.

SUMMARY OF THE INVENTION

It is an object of this invention to overcome the disadvantages of the prior art.

More particularly, it is an object of the invention to provide an improved multiple-unit pump wherein the coupling and driving arrangements for the units are simple and inexpensive.

In keeping with these objects, and with others which will become apparent hereafter, the invention resides in a multiple-unit pump. Briefly stated, the pump may comprise a housing, a first and at least one coaxial second pump unit in said housing, at least said first pump unit being a radial piston pump having a shaft, a cylinder body rotatably mounted on said shaft and provided with radial cylinder bores, and pistons reciprocable in said cylinder bores, said second pump unit having a rotary body coaxial with said cylinder body, an axial bore in said shaft of said first pump unit, a drive shaft for said second pump unit extending through said axial bore, a coupling member mounted on said drive shaft for rotation therewith and being located intermediate said cylinder body and said rotary body, and cooperating coupling portions on said coupling member and said bodies so that said coupling member and said bodies rotate jointly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
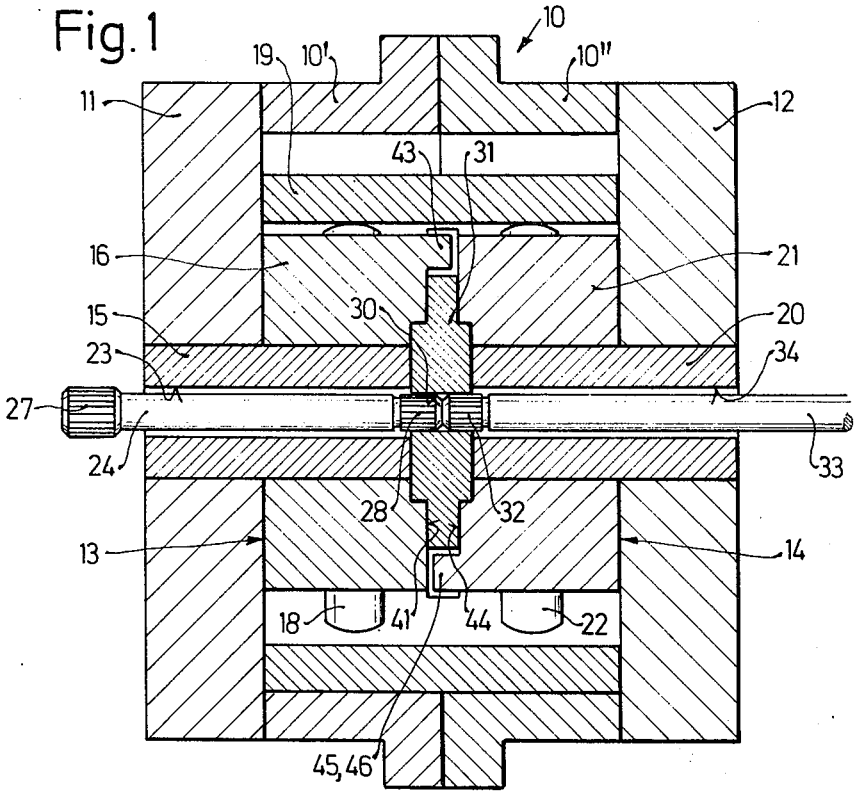
FIG. 1 is an axial section through a muliple-unit pump according to the invention.
Figure 2:
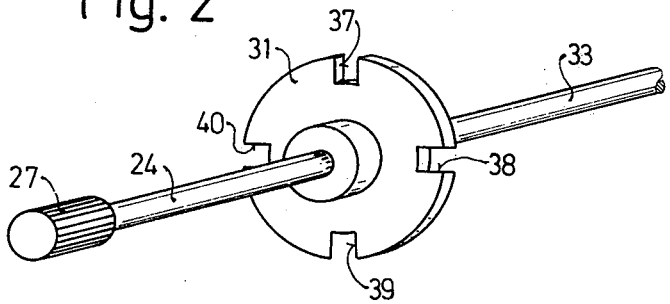
FIG. 2 is a perspective view of a detail of FIG. 1.
Figure 3:
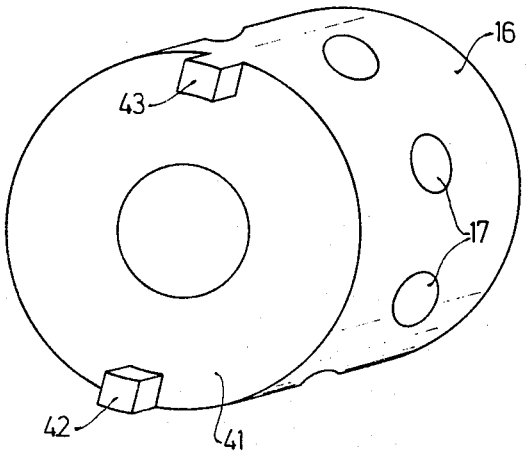
FIG. 3 is a perspective view of another detail of FIG. 1.

FIGS. 1–3 illustrate one embodiment of the invention. The multiple-unit pump of this embodiment has a housing 10 that is composed of two housing sections 10', 10'' and two axially spaced end covers 11, 12. The housing sections 10', 10'' may be connected with one another and with the end covers 11, 12 by means of screws or the like (not shown).

Mounted in the housing 10 are two pump units 13, 14; at least the first unit 13 (but in this embodiment both of the units 13, 14) is a radial piston pump. The construction and operation of radial piston pumps is known per se.

Pump unit 13 has a mounting shaft 15 which is immovably mounted in end cover 11. A rotary cylinder body (or rotor) 16 is turnably mounted on shaft 15 within housing section 10'; it is provided with substantially radial cylinder bores 17 in each of which a piston 18 is reciprocably received. The outer end portions of pistons 18 are (directly or indirectly) in sliding contact with an inner circumferential surface of a control ring 19 that is mounted in housing section 10', 10'' so as to be eccentric with reference to the axis of rotation of body 16. The ring 19 can be fixedly mounted, or an arrangement can be provided (not shown, because known per se in the art) for shifting the ring 19 transversely of its axis. In the former case the piston stroke length is fixed, while in the latter case the piston stroke length may be varied in dependence upon the extent to which the ring 19 is shifted transversely of its axis, and upon the direction in which it is shifted.

The pump unit 14 has a stationary mounting shaft 20 which is immovably mounted in the end cover 12. A cylinder body 21 which is of a construction identical to body 16, is turnably mounted on shaft 20 and formed with substantially radial cylinder bores, each of which accommodates a reciprocable piston 22 which cooperates with the ring 19 as described before.

It should be understood that the shafts 15, 20 are provided — in the manner known per se from the art — with inlet passages and outlet passages for pressure fluid which cooperate with the cylinder bores of the respective bodies 16, 21. These passages have not been illustrated because, as pointed out before, they and their functions are known per se, and also because their illustration is not deemed to be needed for an understanding of the invention.

The mounting shaft 15 is formed with a central axial bore or passage 23 through which a drive shaft 24 extends. The outer end of shaft 24, which extends outwardly of housing 10, is provided with splines 27 for inter-engagement with a coupling portion of a motor or a transmission, so that the shaft 24 may be driven in rotation. The inner end of shaft 24 is located in the housing 10 and is provided with outer splines 28. A disc-shaped coupling member 31 is located intermediate the coaxial cylinder bodies 16, 21; it is formed with a central bore or passage 30 having its inner circumferential boundary surface formed with inner splines which extend over the entire length of bore 30. The portion of shaft 24 which has the splines 28 extends into bore 30 so that its splines mesh with those in the bore 30; however, it extends only about halfway through this bore.

The reason for this last measure is to permit the bore 30 to accommodate an inner end portion of a further drive shaft 33. This inner end portion is also formed with outer splines, designated with numeral 32, which mesh with those in the bore 30. The drive shaft 33 extends through a central axial bore of mounting shaft 20. It may be omitted, but if present it will serve to transmit motion to still another pump unit (not shown) which in FIG. 1 would be arranged to the right of pump unit 14, for example in a second housing arranged adjacent the housing 10. Evidently, still other pump units could be so driven.

The purpose of coupling member 31 is to enforce joint rotation of the bodies 16 and 21, i.e. to couple the pump units 13, 14 for joint operation. The outer circumference of coupling member 31 is formed with four equiangularly spaced recesses, here in form of slots 37, 38, 39 and 40 whose centers are angularly spaced through 90° with reference to the respectively adjacent slots. The end face 41 of cylinder body 16 which is juxtaposed with coupling member 31 is formed with two diametrally opposite axially projecting noses 42, 43 at the periphery of body 16. These noses extend into the slots 37 and 39. Similarly, the end face 44 of cylinder body 21 is formed with two analogous noses 45, 46 which extend into the slots 38, 40 of the coupling member 31.

Thus, the cylinder bodies 16, 21 are coupled in motion-transmitting relationship with the coupling member 31 and, as the latter is mounted on shaft 24 for rotation therewith, they are coupled in motion-transmitting relationship with the shaft 24. A single motion-transmitting member 31 is therefore sufficient to drive the two separate pump units 13, 14, so that a very simple construction is obtained.

Figure 4:
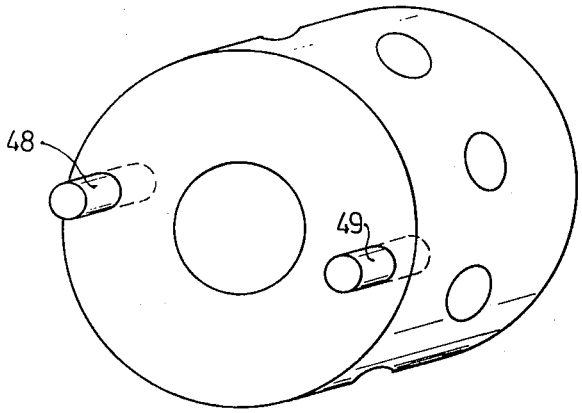
FIG. 4 is a view similar to FIG. 3, but illustrating a somewhat different embodiment.

It will be appreciated that instead of four slots the member 31 might also be provided with a greater number of recesses, or with only two recesses. Each of the bodies 16, 21 could be provided with a single nose, instead of two of them. As FIG. 4 shows, the noses 42, 43, 45, 46 could be replaced by other projections, such as the pins 48, 49 which are fixedly mounted in bores in the respective cylinder bodies. Otherwise, the embodiment of FIG. 4 would be identical to that of FIGS. 1–3. In place of a single ring 19, each of the units 13, 14 could be provided with a separate ring 19, and these could be independently shiftable transversely of their respective axes so as to permit independent adjustment of the piston stroke length for the two units 13 and 14.

It will be understood that each of the elements described above, or two or more together, may also find a useful application in other types of constructions differing from the types described above.

While the invention has been illustrated and described as embodied in a multiple-unit pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multiple-unit pump, comprising a housing; a first and at least one coaxial second pump unit in said housing, at least said first pump unit being a radial piston pump having a fixedly mounted first cantilevered supporting shaft, a cylinder body rotatably mounted on said first supporting shaft and provided with radial cylinder bores, and pistons reciprocable in said cylinder bores, said second pump unit having a fixedly mounted second cantilevered supporting shaft and a rotary body coaxial with said cylinder body, rotatably mounted on said second supporting shaft and having a fluid chamber means; an axial bore in said first supporting shaft of said first pump unit; a drive shaft for said second pump unit extending through said axial bore; a coupling member mounted on said drive shaft for rotation therewith and being located between said first and second supporting shafts and intermediate said cylinder body and said rotary body; cooperating coupling portions on said coupling member and said bodies so that said coupling member and said bodies rotate jointly; and means communicating said bores and chamber means with the exteriors of said bodies for admission and discharge of fluid being pumped.

2. A multiple-unit pump as defined in claim 1, wherein said coupling portions comprise four circumferentially spaced equi-distant recesses in said coupling member, and two pair of projections on the respective bodies and engaging in respective ones of said recesses.

3. A multiple-unit pump as defined in claim 1, wherein said second pump unit also is a radial piston pump and said rotary body thereof is a cylinder body having radial bores constituting said chamber means and pistons reciprocable in the same.

4. A multiple-unit pump as defined in claim 3, wherein said coupling member is a disc, and said coupling portions comprise at least two recesses in said disc, and at least one projection on each of said cylinder bodies and received in one of said recesses.

5. A multiple-unit pump as defined in claim 1, wherein said coupling portions comprise slot-shaped recesses formed in said coupling member, and projections on said bodies and each extending into one of said recesses.

6. A multiple-unit pump as defined in claim 5, wherein said projections are noses.

7. A multiple-unit pump as defined in claim 5, wherein said projections are pins.

8. A multiple-unit pump as defined in claim 1, said coupling member having a central axial passage, and said drive shaft having a shaft portion lodged in motion-transmitting relationship within said axial passage.

9. A multiple-unit pump as defined in claim 8; further comprising a further drive-shaft for at least one additional pump unit, said further drive shaft having a further shaft portion also lodged in said axial passage in motion-receiving relationship so that said further drive shaft rotates in unison with said coupling member and the first-mentioned drive shaft.

10. A multiple-unit pump as defined in claim 9, wherein said axial passage and said shaft portions are formed with inter-engaging axial splines.

* * * * *